United States Patent [19]

Poll

[11] 4,447,954

[45] May 15, 1984

[54] ELLIPSOGRAPH

[76] Inventor: Marian Poll, 1271 Northwest Hwy., Park Ridge, Ill. 60068

[21] Appl. No.: 474,974

[22] Filed: Mar. 14, 1983

[51] Int. Cl.[3] ..... B43L 11/04

[52] U.S. Cl. ..... 33/30 D; 33/31

[58] Field of Search ..... 33/30, 31

[56] References Cited

U.S. PATENT DOCUMENTS 520,003 5/1894 Lehner ..... 33/30 D 2,762,126 9/1956 Shaw ..... 33/31

*Primary Examiner*—Harry N. Haroian

[57] ABSTRACT

Drafting instrument for drawing ellipses using scribe arm and members capable of being pivotally connected at two points along the scribe arm, one of the members being constrained to move along a straight line congruent to the minor axis and the other of the members being constrained to move along a straight line congruent to the major axis, as the members reciprocate along their respective lines, a point of the scribe arm describes an ellipse.

1 Claim, 2 Drawing Figures

ELLIPSOGRAPH

BACKGROUND OF THE INVENTION

This invention deals with an ellipsograph, more specifically, it relates to the type designed to be laid flat on the work and manipulated to describe an ellipse, once the dimensions of the two axis are known. The instrument can be adjusted with ease and to an infinite number of proportions.

SUMMARY OF THE INVENTION

According to the present invention, a complete ellipse, or parts thereof, may be drawn by the use of a scribe arm fixed at two points, with one point constrained to move along a straight line congruent to minor axis and the other point, which is constrained to move along a straight line, congruent to the major axis.

The advantages of the instant invention are it's simplicity of construction and it's ease of use, thereby affording a device which is relatively cheap and convenient to use but quite accurate. These advantages are not simultaneously present in any prior art instrument.

The invention will be more readily understood and other objects and advantages will become apparent from the study of the following portion of this application, the claims and the attached drawings, in which:

DESCRIPTION OF THE PREFERRED EMBODIMENT

Figure 1:
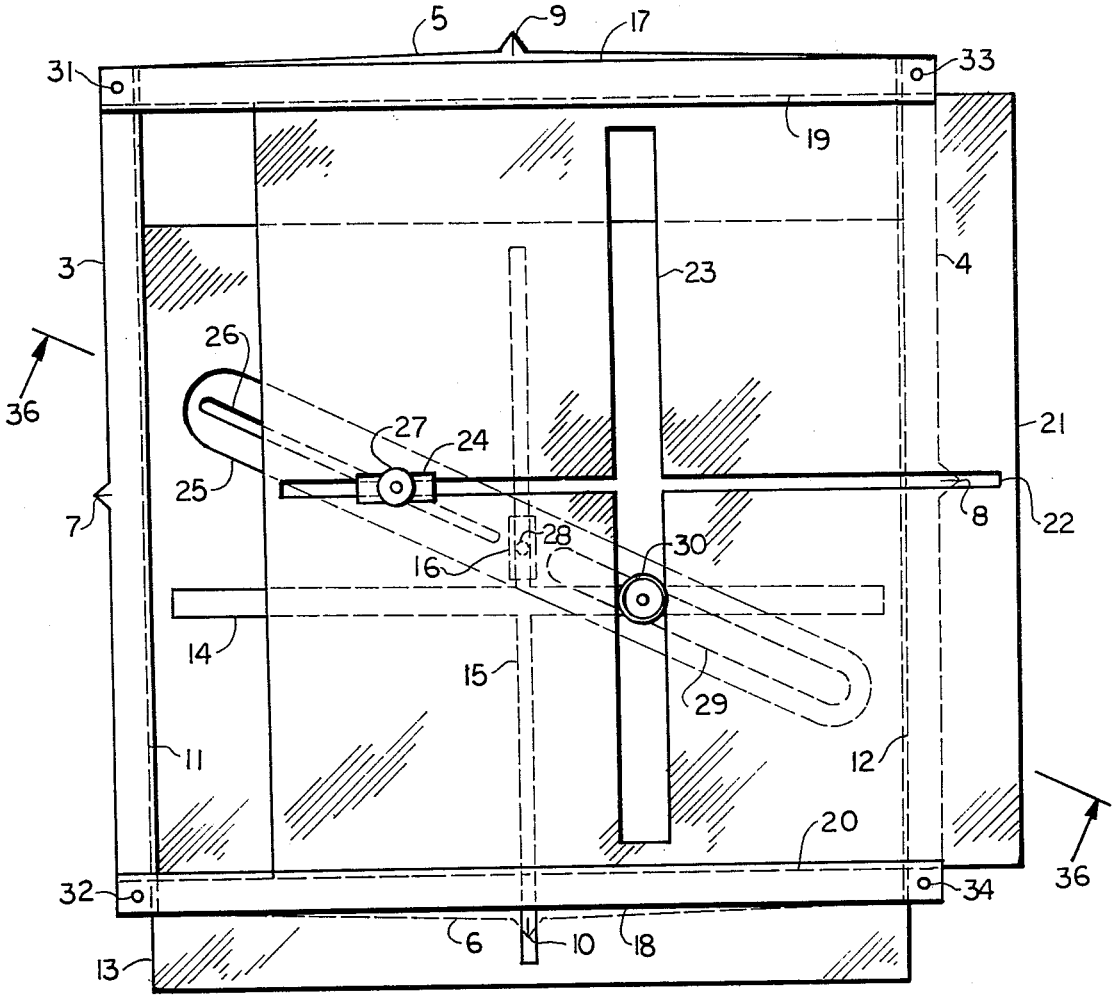
FIG. 1 depicts a top or plan view
Figure 2:
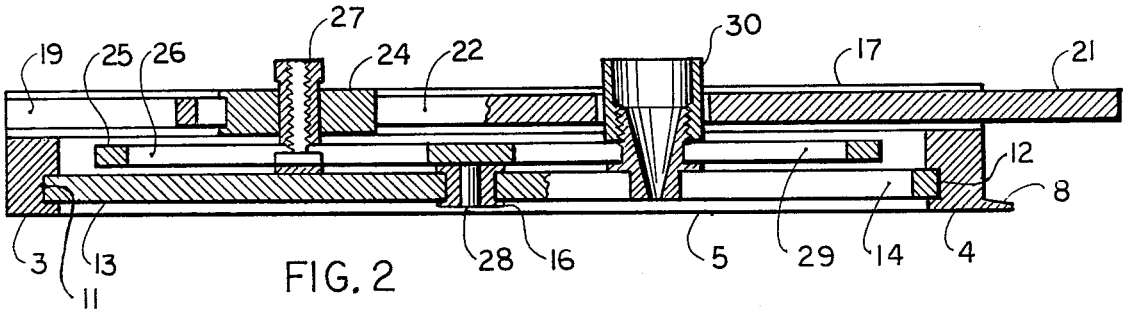
FIG. 2 shows enlarged cross-sectional view taken along line 36—36.

Referring to the drawing numbers 3, 4, 5 and 6 indicates lower base members. The outer edges of the base members 3, 4, 5 and 6 are provided with center line indicators 7, 8, 9 and 10 at it's centers, respectively. And, the inner edges of numbers 3 and 4 are provided with grooves 11 and 12, respectively. Slideably mounted within the grooves is cross-slotted plate 13, comprising slot 14 and 15. In the slot 15, slideably mounted, is bridge bearing 16, long enough to bridge slot 14. Rigidly affixed at both ends to the ends of the lower base members is upper base comprising members 17 and 18. The inner edges of the members 17 and 18 are provided with grooves 19 and 20, respectively. A cross-slotted plate 21 comprising slot 22 and 23 is slideably mounted within the grooves. In the slot 22 slideably mounted, is bridge bearing 24, long enough to bridge slot 23. A scribe arm 25 having at it's first end legthwise slot 26, a first rotably connecting means 27 between the slot and bridge bearing 24. Means 27 designed to slide in the slot and to be locked in to the scribe arm at any desired point. A second rotably connecting means between scribe arm and bridge bearing 16 is shaft 28, fixed at the center of the scribe arm 25. Second end of scribe arm 25 having lengthwise slot 29 for mounting drafting instruments means 30. Drafting instrument means 30 capable of sliding in slots 14, 23 and 29 and designed to be locked on scribe arm 25 on any desired point. Numbers 31, 32, 33 & 34 indicate fastening pin holes.

Operation of the Ellipsograph

Place the ellipsograph on a graphic surface. Align center line indicator 7 and 8 with minor axis and center line indicator 9 and 10 with major axis. Align scribe arm 25 with minor axis. Slide means for mounting drafting instrument 30 on a point indicating half of the minor axis. Secure means 30. Align scribe arm 25 with major axis. Unlock means 27. Slide means 30 to a point indicating half of major axis. Lock means 27. Place drafting instrument into means 30 and draw.

While I have described the invention along specific lines, various minor changes or refinements may be made therein without departing its principle. And, I reserve the right to employ all such changes and refinements as may come within the scope and spirit of the appended claims.

What I claim as new is:

1. A drafting instrument for tracing an entire ellipse, or parts thereof, comprising a lower base with first and second side members and first and second end members, each of said members bearing center line indicator on its outer edge and a groove on the inner edge between points adjacent to each end, with another center line indicator on each outer edge of the end members of the lower base at their center, a cross-slotted plate slideably mounted within said grooves, a lower bridge bearing slideably mounted within said cross-slot specifically in the slot parallel to said grooves, an upper base rigidly affixed at both ends to the ends of the lower base side members, said upper base having a first and a second side members, each of the said upper base side members bearing an inner edge groove between points adjacent to each end and set normal to the grooves of the lower base, an upper cross-slotted plate slideably mounted within said grooves, an upper bridge bearing slideably mounted within said cross-slotted plate specifically in the slot parallel to the said grooves, a scribe arm having a lengthwise slot between points adjacent to the first end to a point adjacent to the center, and a lengthwise slot between points adjacent to the center to a point adjacent to the second end, said scribe arm having mounted in the slot at its first end first rotably connecting means between the upper bridge bearing and said slot, second rotably connecting means between the lower bridge bearing and the center of said scribe arm, means for mounting a drafting instrument mounted in said slot at a point near the second end of said scribe arm, said means projecting and sliding freely into the slots of lower and upper cross-slotted plates, specifically, in the slots perpendicular to corresponding mounting grooves, and mounting holes through each corner of the lower and upper base.

* * * * *